US008550131B1

(12) United States Patent
Shenkman et al.

(10) Patent No.: US 8,550,131 B1
(45) Date of Patent: Oct. 8, 2013

(54) LIQUID DISPENSING DEVICE, SYSTEM AND METHOD

(71) Applicant: Liquid Squeeze LLC, West Palm Beach, FL (US)

(72) Inventors: Brian Shenkman, West Palm Beach, FL (US); David J. Carson, Stuart, FL (US); Michael C. Romeo, Port St. Lucie, FL (US); Carole Shenkman, Boynton Beach, FL (US); Kenneth Shenkman, Lake Worth, FL (US)

(73) Assignee: Liquid Squeeze, LLC, West Palm Beach, FL (US)

( * ) Notice: Subject to any disclaimer, the term of this patent is extended or adjusted under 35 U.S.C. 154(b) by 0 days.

(21) Appl. No.: 13/732,901

(22) Filed: Jan. 2, 2013

(51) Int. Cl.
*B65B 1/04* (2006.01)

(52) U.S. Cl.
USPC ..... 141/351; 141/2; 141/24; 222/207; 222/214

(58) Field of Classification Search
USPC ..... 141/2, 23, 24, 346, 351, 352, 353, 141/357; 222/207, 214
See application file for complete search history.

(56) References Cited

U.S. PATENT DOCUMENTS

| | | | |
|---|---|---|---|
| 3,870,201 | A | 3/1975 | Asplund |
| 4,006,850 | A | 2/1977 | Farina |
| 4,090,752 | A | 5/1978 | Long |
| 4,129,159 | A | 12/1978 | Whetstone |
| 4,130,224 | A | 12/1978 | Norman et al. |
| 4,147,770 | A | 4/1979 | Sichak |
| 4,201,765 | A | 5/1980 | Sichak |
| 4,215,799 | A | 8/1980 | Swaine |
| 4,226,736 | A | 10/1980 | Bush |
| 4,247,281 | A | 1/1981 | McGrew |
| 4,270,355 | A | 6/1981 | Green |
| 4,307,474 | A | 12/1981 | Choy |
| 4,393,971 | A | 7/1983 | Wilson |
| 4,436,615 | A | 3/1984 | Boodman |
| 4,464,412 | A | 8/1984 | Washburn |
| 4,515,294 | A | 5/1985 | Udall |
| 4,547,143 | A | 10/1985 | Cerreta |
| 4,570,829 | A | 2/1986 | Allen |
| 4,575,375 | A | 3/1986 | Kozam |
| 4,657,501 | A | 4/1987 | Klacik |

(Continued)

FOREIGN PATENT DOCUMENTS

| | | |
|---|---|---|
| JP | H05172062 | 7/1993 |
| JP | H05306000 | 11/1993 |

(Continued)

*Primary Examiner* — Jason K Niesz
(74) *Attorney, Agent, or Firm* — Duane Morris LLP; J. Rodman Steele, Jr.; Gregory M. Lefkowitz

(57) ABSTRACT

A liquid dispensing device, system and method are disclosed. The liquid dispensing device includes a one-way liquid metering device, comprising a bellows, an inlet valve, and an outlet valve; and a housing, comprising a cavity. The outlet valve is recessed within the cavity and liquid is dispensed from the one-way metering device into the cavity when a proximal portion of a receptacle is inserted into the cavity. Liquid within the bellows is dispensed from the outlet valve when the bellows is compressed, and liquid is drawn into the bellows through the inlet valve when the bellows returns to an expanded state. The system can include a receptacle with a neck extending from a shoulder at the proximal end of the receptacle. The shoulder engages with the at least one surface.

20 Claims, 10 Drawing Sheets

(56) References Cited

U.S. PATENT DOCUMENTS

| | | | | |
|---|---|---|---|---|
| 4,728,008 | A | 3/1988 | Graf | |
| 4,817,868 | A | 4/1989 | Cook | |
| 4,891,388 | A | 1/1990 | Graiver | |
| 4,895,276 | A | 1/1990 | Maldonado | |
| 4,896,798 | A | 1/1990 | Milton | |
| 4,927,545 | A | 5/1990 | Roginski | |
| 4,961,508 | A | 10/1990 | Weimer et al. | |
| 4,978,030 | A | 12/1990 | Morris | |
| 4,982,041 | A | 1/1991 | Campbell | |
| 4,986,475 | A | 1/1991 | Spadafora | |
| 4,998,850 | A | 3/1991 | Crowell | |
| 5,060,858 | A | 10/1991 | Santini | |
| 5,082,150 | A | 1/1992 | Steiner et al. | |
| 5,145,095 | A | 9/1992 | Loudon | |
| 5,232,127 | A | 8/1993 | Trotta | |
| 5,242,083 | A | 9/1993 | Christine et al. | |
| 5,248,066 | A | 9/1993 | Olson et al. | |
| 5,265,772 | A | 11/1993 | Bartasevich et al. | |
| 5,284,897 | A | 2/1994 | Columbus | |
| 5,300,302 | A | 4/1994 | Tachon | |
| 5,306,749 | A | 4/1994 | Columbus | |
| 5,322,880 | A | 6/1994 | Columbus | |
| 5,356,035 | A | 10/1994 | Shlopak | |
| 5,356,038 | A | 10/1994 | Banks | |
| 5,370,829 | A | 12/1994 | Kunze | |
| 5,411,182 | A | 5/1995 | Marte | |
| 5,464,125 | A | 11/1995 | Daansen | |
| 5,473,005 | A | 12/1995 | Columbus | |
| RE35,144 | E | 1/1996 | Columbus | |
| 5,501,372 | A | 3/1996 | Daansen | |
| 5,505,959 | A | 4/1996 | Tachon | |
| 5,551,604 | A | 9/1996 | Kern et al. | |
| 5,560,519 | A | 10/1996 | Moore et al. | |
| 5,567,753 | A | 10/1996 | Shuman | |
| 5,616,243 | A | 4/1997 | Levy | |
| 5,683,012 | A | 11/1997 | Villaveces | |
| 5,708,810 | A | 1/1998 | Kern | |
| 5,726,106 | A | 3/1998 | Klason | |
| 5,738,122 | A | 4/1998 | Armbruster | |
| 5,819,986 | A | 10/1998 | Last | |
| 5,823,393 | A | 10/1998 | Hafstrom | |
| 5,853,112 | A | 12/1998 | Coleman | |
| 5,879,932 | A | 3/1999 | Van Erdewyk | |
| 5,891,400 | A | 4/1999 | Ansari | |
| 5,922,237 | A | 7/1999 | Green | |
| 5,927,085 | A | 7/1999 | Waldman | |
| 5,927,548 | A | 7/1999 | Villaveces | |
| 5,939,101 | A | 8/1999 | Green | |
| 6,009,887 | A | 1/2000 | Hertel | |
| 6,015,155 | A | 1/2000 | Brookes | |
| 6,030,138 | A | 2/2000 | Losier | |
| 6,036,058 | A | 3/2000 | Chou | |
| 6,039,266 | A | 3/2000 | Santini | |
| 6,047,746 | A | 4/2000 | Green | |
| 6,062,362 | A | 5/2000 | Costin | |
| 6,136,352 | A | 10/2000 | Silverstein | |
| 6,145,553 | A | 11/2000 | Sofy | |
| 6,199,724 | B1 | 3/2001 | Yeranossian | |
| 6,244,472 | B1 | 6/2001 | Hennemann | |
| 6,261,076 | B1 | 7/2001 | Kuwahara et al. | |
| 6,267,297 | B1 | 7/2001 | Contadini | |
| 6,338,403 | B1 | 1/2002 | Costin | |
| 6,354,470 | B1 | 3/2002 | Berger | |
| 6,357,945 | B1 | 3/2002 | Losier | |
| 6,368,646 | B1 | 4/2002 | Monow | |
| 6,394,320 | B1 | 5/2002 | Feiman | |
| 6,440,912 | B2 | 8/2002 | McGee | |
| 6,450,722 | B1 | 9/2002 | Ruschke | |
| 6,454,128 | B1 | 9/2002 | Harris | |
| 6,488,665 | B1 | 12/2002 | Severin | |
| 6,511,445 | B2 | 1/2003 | Sivan | |
| 6,516,974 | B2 | 2/2003 | Straus et al. | |
| 6,536,977 | B1 | 3/2003 | Hammel | |
| 6,561,389 | B1 | 5/2003 | Earle | |
| 6,579,079 | B2 | 6/2003 | Krevald | |
| D476,855 | S | 7/2003 | Green | |
| 6,592,278 | B1 | 7/2003 | Holthaus | |
| 6,619,510 | B2 | 9/2003 | Green | |
| 6,623,257 | B2 * | 9/2003 | Taniguchi | 417/478 |
| 6,637,497 | B2 | 10/2003 | Herron | |
| 6,688,135 | B1 | 2/2004 | Mattia | |
| 6,729,996 | B2 | 5/2004 | Green | |
| 6,730,339 | B2 | 5/2004 | Chan | |
| 6,755,327 | B1 | 6/2004 | Hazard | |
| 6,814,111 | B1 | 11/2004 | Oliverio | |
| 6,874,551 | B1 | 4/2005 | Snell | |
| 6,889,727 | B2 | 5/2005 | Olson | |
| 6,890,119 | B2 | 5/2005 | Ruschke | |
| 6,890,588 | B2 | 5/2005 | Liberkowski | |
| 6,902,085 | B2 | 6/2005 | Bougamont | |
| 6,923,587 | B2 | 8/2005 | Lee | |
| 6,926,166 | B1 | 8/2005 | Bitton | |
| 6,969,209 | B2 | 11/2005 | Apar | |
| 6,978,912 | B2 | 12/2005 | Taylor | |
| 6,988,638 | B2 | 1/2006 | Zak | |
| 6,994,270 | B2 | 2/2006 | Wongosari | |
| 7,007,862 | B2 | 3/2006 | Chiang | |
| 7,025,232 | B2 | 4/2006 | Green | |
| 7,055,684 | B2 | 6/2006 | Anderson | |
| 7,101,106 | B1 | 9/2006 | Wiley | |
| D532,246 | S | 11/2006 | Lane | |
| 7,147,822 | B2 | 12/2006 | Parkhurst | |
| 7,174,310 | B2 | 2/2007 | Bartholomew | |
| 7,204,076 | B2 | 4/2007 | Griffiths | |
| D542,352 | S | 5/2007 | Green et al. | |
| 7,241,339 | B2 | 7/2007 | Liberkowski | |
| 7,252,854 | B2 | 8/2007 | Liberkowski | |
| 7,415,983 | B2 | 8/2008 | Griese | |
| D581,218 | S | 11/2008 | Green et al. | |
| 7,540,397 | B2 | 6/2009 | Muderlak | |
| 7,555,360 | B1 | 6/2009 | Green et al. | |
| 7,588,062 | B1 | 9/2009 | Green | |
| 7,588,169 | B1 | 9/2009 | Green et al. | |
| 7,617,952 | B2 | 11/2009 | Saleh | |
| 7,735,694 | B2 | 6/2010 | Brown et al. | |
| 7,770,874 | B2 | 8/2010 | Ophardt | |
| 7,814,661 | B2 | 10/2010 | Tomassetti | |
| 7,832,025 | B2 | 11/2010 | Virica | |
| 8,087,553 | B2 | 1/2012 | Pardes | |
| 8,104,644 | B2 | 1/2012 | Py | |
| RE43,329 | E | 4/2012 | Py | |
| 8,240,516 | B2 | 8/2012 | Lautre | |
| 2004/0262334 | A1 | 12/2004 | Green | |
| 2005/0031475 | A1 | 2/2005 | Taniguchi | |
| 2005/0126653 | A1 | 6/2005 | Tachikawa | |
| 2007/0080175 | A1 | 4/2007 | Petersen | |
| 2007/0108236 | A1 | 5/2007 | O'Connell | |
| 2007/0157991 | A1 * | 7/2007 | Robertson | 141/360 |
| 2008/0135583 | A1 | 6/2008 | Caswell | |
| 2009/0065092 | A1 | 3/2009 | Green et al. | |
| 2009/0136370 | A1 | 5/2009 | Goodwin | |
| 2009/0184136 | A1 | 7/2009 | Ciavarella | |
| 2009/0188963 | A1 | 7/2009 | Yang | |
| 2010/0301070 | A1 | 12/2010 | Allef | |
| 2011/0056990 | A1 | 3/2011 | Proper | |

FOREIGN PATENT DOCUMENTS

| | | |
|---|---|---|
| JP | H06191596 | 7/1994 |
| JP | H08217167 | 6/1996 |
| JP | 2000257564 | 9/2000 |
| JP | 2004331118 | 11/2004 |

* cited by examiner

LIQUID DISPENSING DEVICE, SYSTEM AND METHOD

FIELD OF THE DISCLOSURE

The present disclosure relates generally to a liquid dispensing device, system and method, particularly, for dispensing discrete amounts of viscous liquid into a receptacle without dripping.

BACKGROUND

Sweets have been produced for thousands of years. Over those years, the variety of flavors and types of candy have expanded vastly. Despite the wide selection available to consumers, there remain candy innovators who continue to develop new flavors and types of candy, as well as, interesting ways of enhancing the candy consumer's sensory experience.

SUMMARY OF THE INVENTION

The liquid dispensing device described herein can include a one-way liquid metering device and a housing. The liquid metering device can include a bellows, an inlet valve, and an outlet valve. The housing can include a cavity and the outlet valve can be recessed within the cavity. The liquid can be dispensed from the one-way metering device into the cavity when a proximal portion of a receptacle is inserted into the cavity. The liquid within the bellows can be dispensed from the outlet valve when the bellows is compressed, while liquid can be drawn from a liquid reservoir into the bellows through the inlet valve when the bellows returns to an expanded state.

The longitudinal-axes of the cavity and the bellows can be parallel. The inlet end of the one-way liquid metering device can be in fluid communication with the fluid reservoir.

The liquid dispensing device can include an actuator for causing compression of the bellows when a proximal end of a receptacle is inserted into the cavity. The metering device can include a flange proximate the outlet valve and the actuator can include a groove for engaging the metering device flange.

The actuator can include at least one surface for engaging with a proximal portion of a receptacle inserted into the cavity. The at least one surface can include at least one projection extending into the cavity. The actuator can be slidably coupled with one or more walls defining the cavity via the at least one projection. The at least one projection can extend from an interior surface of the actuator.

The exterior surface of the actuator can be slidably coupled to an interior surface of the housing. An exterior surface of the actuator can be slidably coupled an interior surface of the housing A system for liquid dispensing is also described. The system can include a liquid dispensing device described herein and a receptacle having a proximal end adapted for insertion into the cavity.

The receptacle can also include a neck extending from a shoulder at the proximal end of the receptacle, where the shoulder fits within the cavity. The shoulder can engage with the at least one surface of the actuator.

The liquid dispensing device can include an actuator for causing compression of the bellows when a proximal end of the receptacle is inserted into the cavity, and the actuator can include at least one surface for engaging with a proximal portion of a receptacle inserted into the cavity. The one-way liquid metering device can include a flange proximate the outlet valve and the actuator can include a groove for engaging the flange.

A method of dispensing a liquid into a receptacle is also described. The method can include providing a liquid dispensing device as described herein, and a receptacle having a proximal end adapted for insertion into a cavity of the liquid dispensing device. The method can also include inserting the proximal end into the cavity to dispense a liquid from the liquid dispensing device. The method can also include providing a second liquid dispensing device; and inserting the proximal end into a cavity of the second liquid dispensing device to dispense a liquid from the second liquid dispensing device.

These and other features, objects and advantages of the present method and system will become more apparent to one skilled in the art from the following description and claims when read in light of the accompanying drawings.

BRIEF DESCRIPTION OF THE DRAWINGS

FIG. 2A is a cross-section view of the liquid dispensing device of FIG. 1 taken along cut line 2-2, where the bellows is in the expanded state, while

DETAILED DESCRIPTION

Figure 1:
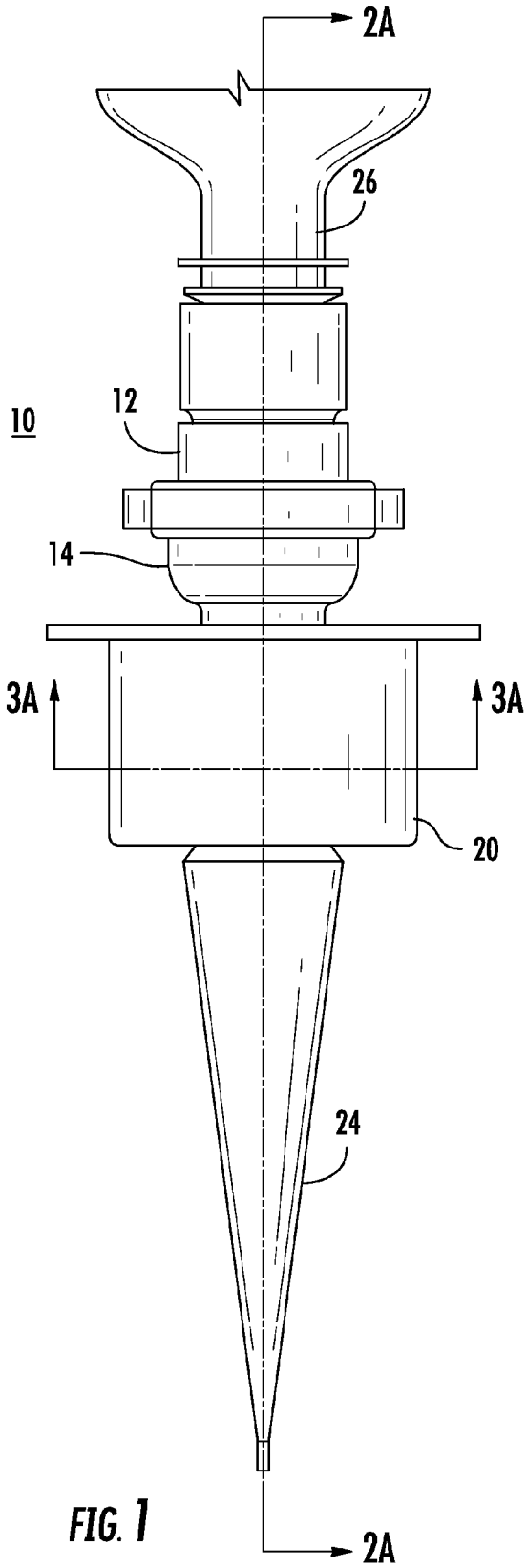
FIG. 1 is a front view of a liquid dispensing device as described herein.

A liquid dispensing device, system and method is described. The liquid dispensing device described herein can be used to dispense viscous fluids into a receptacle inserted into a cavity of the device. This technology can be used in a wide range of applications, such as, allowing consumers to dispense bulk liquid candy from one or more dispensers into a receptacle for subsequent consumption. When the receptacle body is transparent and the various dispensers include bulk liquid candy with different colors (and flavors), the consumer can enjoy viewing layers of differently colored liquid candy through the receptacle body while they enjoy their liquid candy treat.

As shown in FIGS. 1-9B, the system 10 can include a liquid dispensing device 11, and a receptacle 24. The liquid dispensing device 11 can include a one-way liquid metering device 12 that includes a bellows 14, an inlet valve 16, and an outlet valve 18; and a housing 20 that includes a cavity 22. The outlet valve 18 can be recessed within the cavity 22 and liquid can be dispensed from the one-way metering device 12 into the cavity 22 when a proximal portion 25 of a receptacle 24 is inserted into the cavity 22.

The inlet valve 16 and outlet valve 18 can be one-way valves capable of functioning as described herein. However, it is important that the outlet valve 18 be dripless or close to dripless in order to prevent liquid from being dispensed from the liquid dispensing device 11 when the receptacle 24 is not inserted into the cavity 22.

Figure 8:
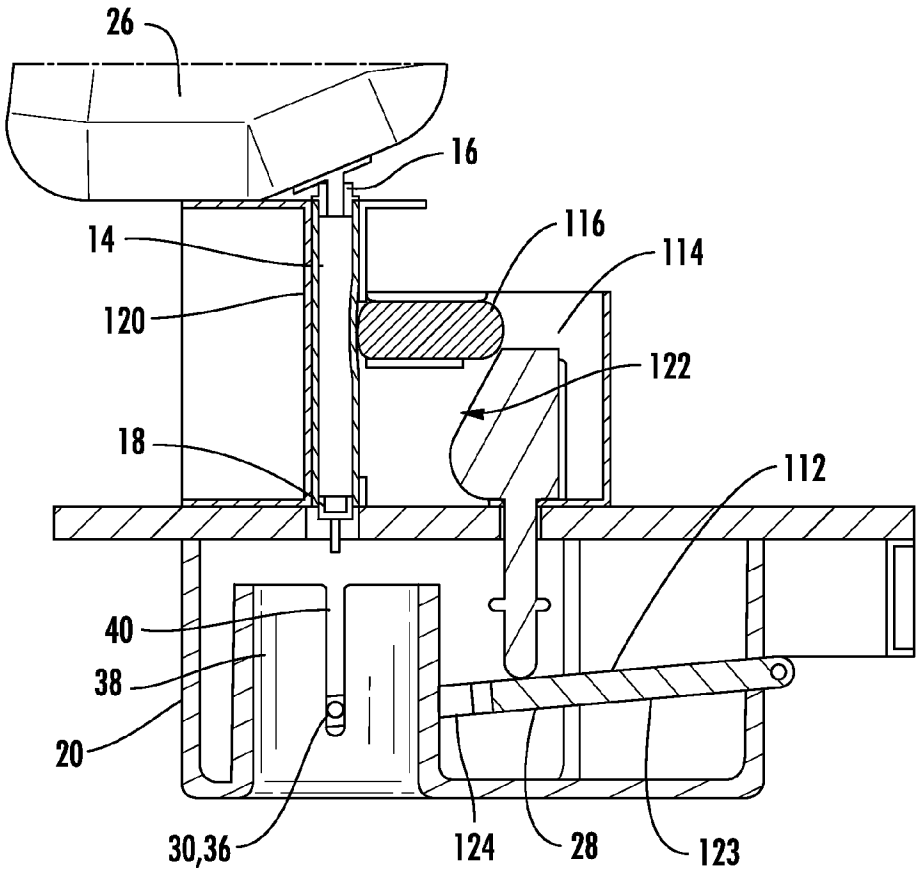
FIG. 8 is a cross-section view of an alternate liquid dispensing device in the uncompressed, start position.

Each liquid dispensing device 11 can be in fluid communication with a liquid reservoir 26. As shown in FIGS. 2 & 8, an end of the one-way liquid metering device 12 proximate the inlet valve 16 can be coupled to the liquid reservoir 26 for storing a supply of the liquid being dispensed by the one-way liquid metering device 12.

Figure 2A:
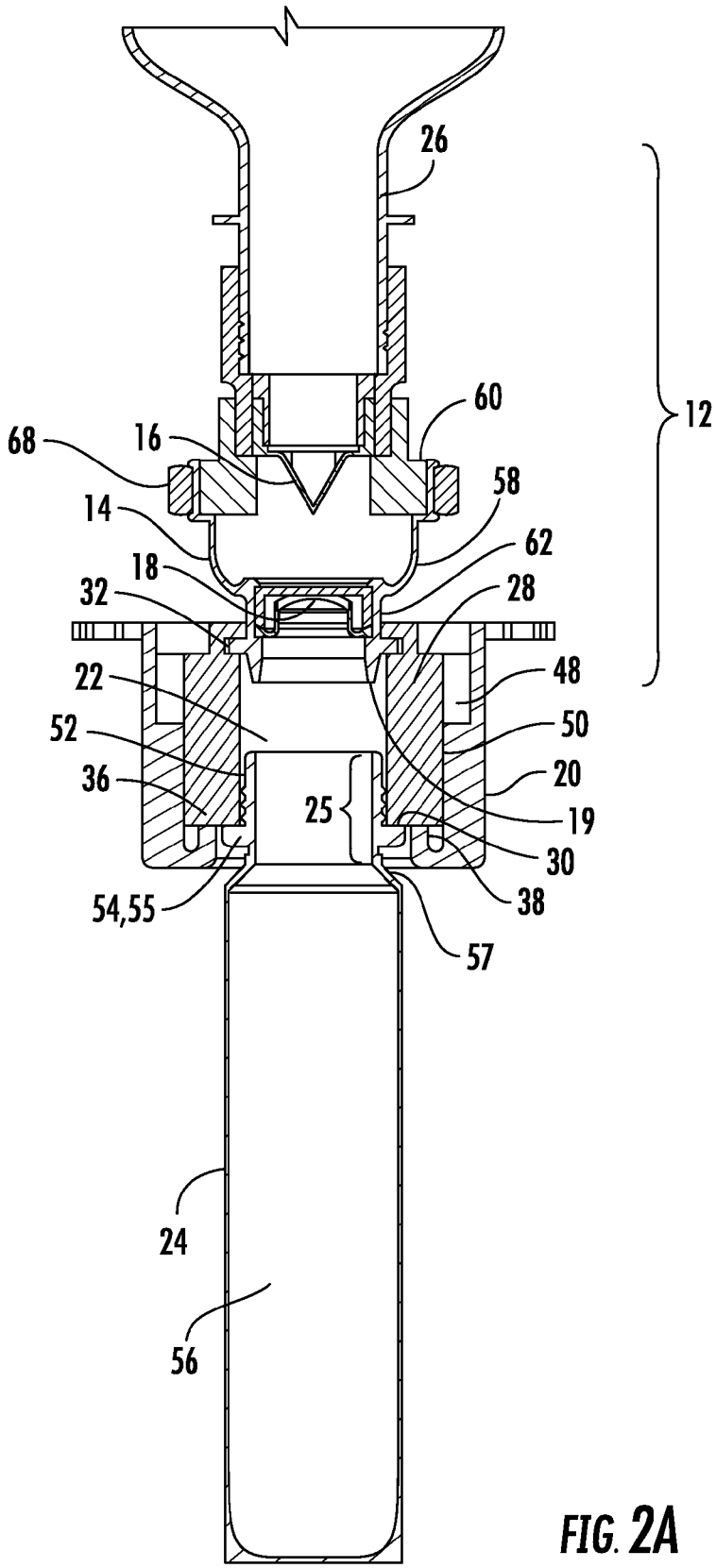
Figure 2B:
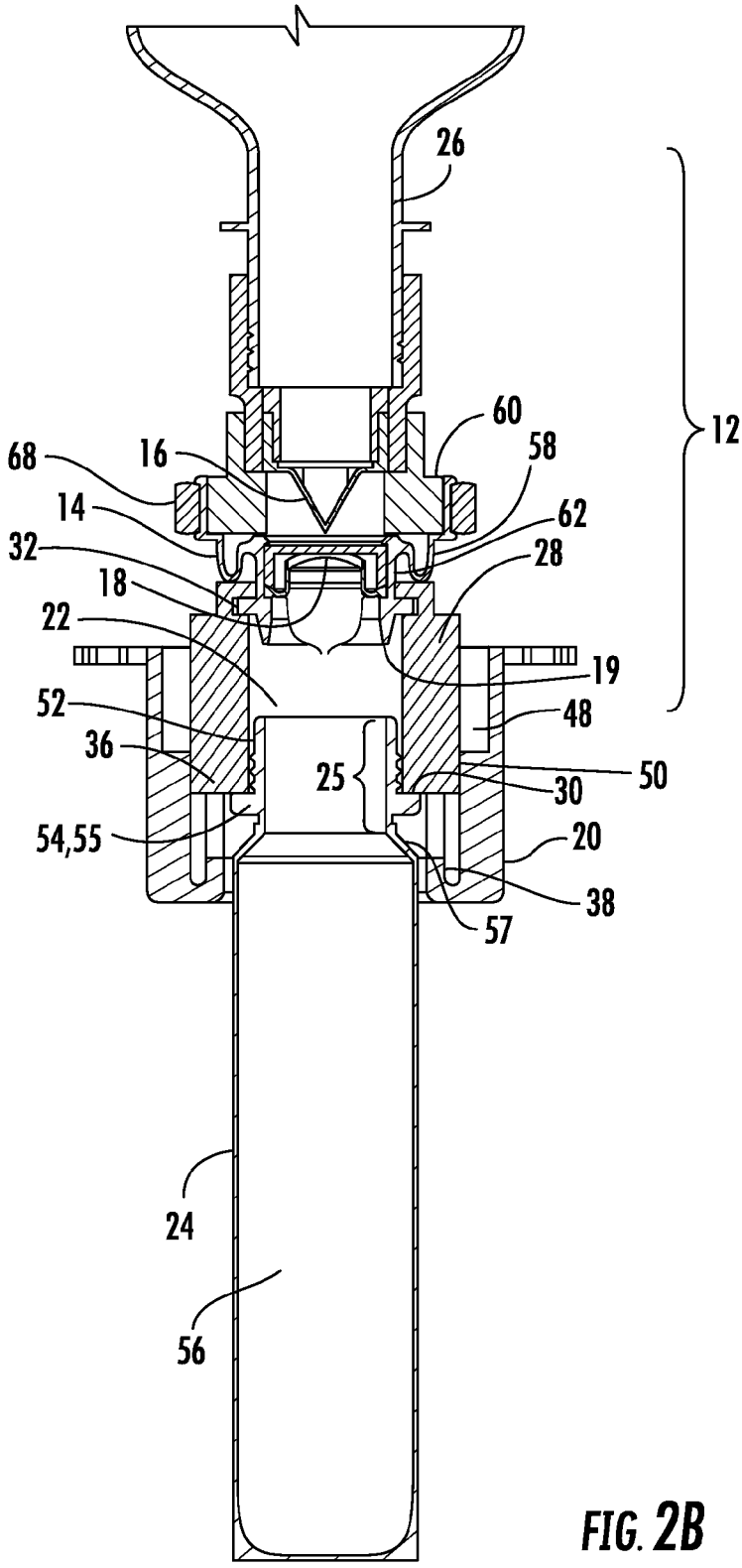
FIG. 2B is a cross-section of the same liquid dispensing device where the bellows is in the compressed state.
Figure 9B:
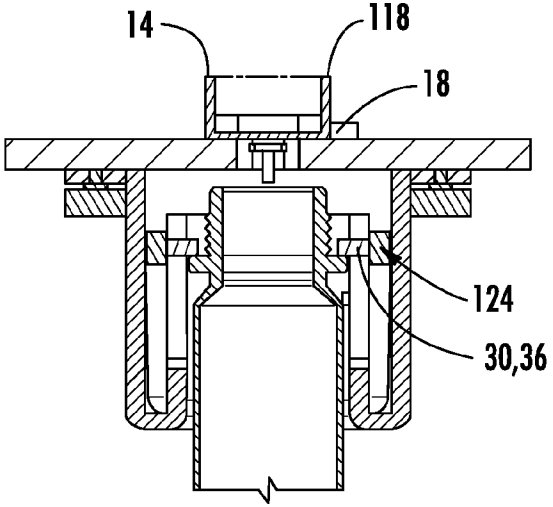
FIG. 9B is a cross-section view of the device of FIG. 9A taken along cut line B-B.
Figure 9A:
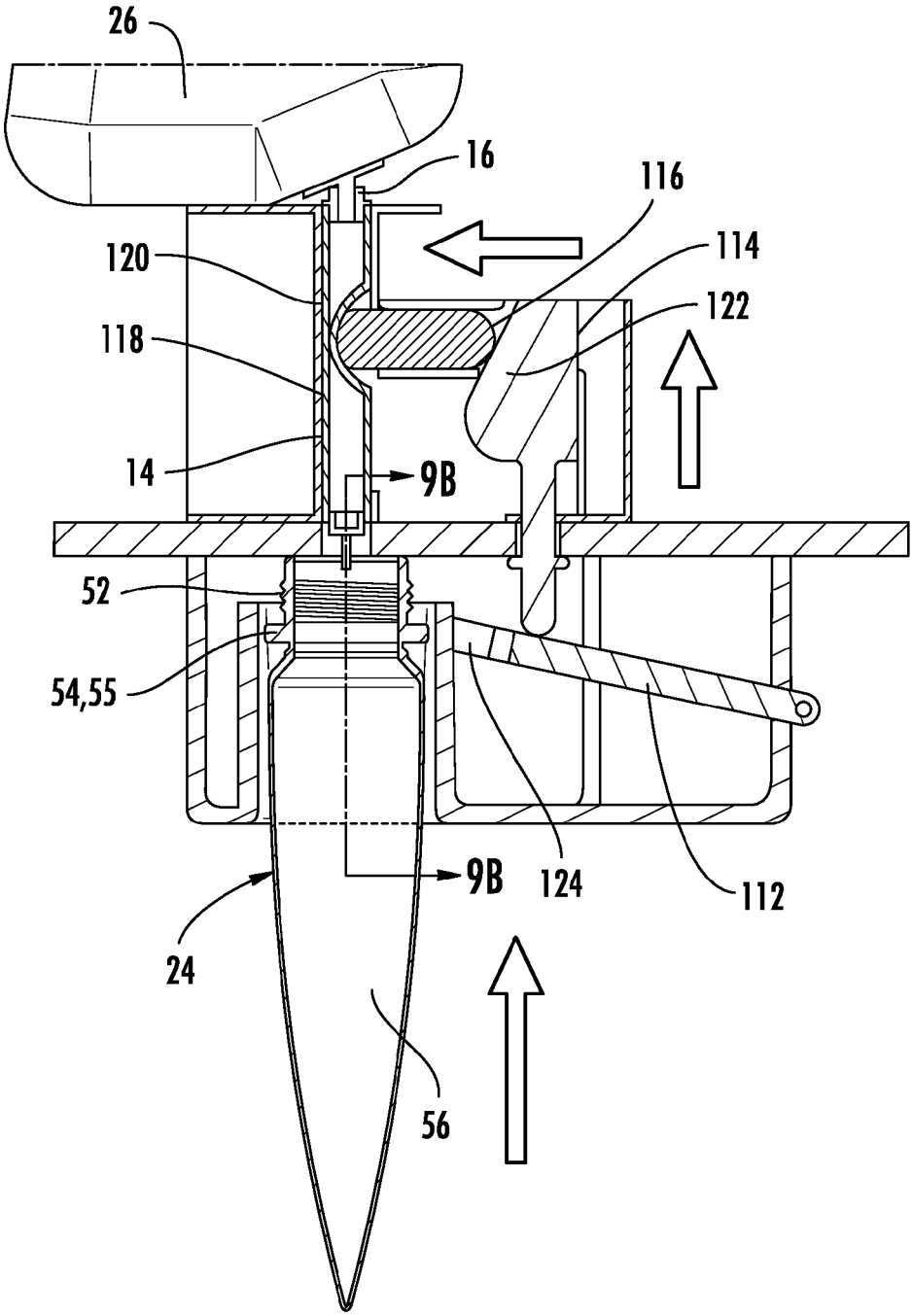
FIG. 9A is a cross-section view of the alternate liquid dispensing device in the compressed position with the receptacle inserted in the cavity.

The one-way metering device 12 can be designed so that liquid within the bellows 14 is dispensed from the outlet valve 18 when the bellows 14 is compressed, as shown in FIGS. 2A & 9A. In contrast, liquid is drawn from the liquid reservoir 26 into the bellows 14 through the inlet valve 16 when the bellows 14 returns to an expanded state, as shown in FIGS. 2B and 9B. The actuator 28 can be biased to return to the start position (e.g., expanded state) when the receptacle is removed from the cavity 22. The bias can be provided by appropriate means, including the resiliency of the bellows 14.

In order to facilitate this method of dispensing, the bellows 14 can be formed of a resilient material that enables the bellows 14 to return to its original shape once the compression force is removed. In addition, the shape of the bellows can facilitate return to the original shape, e.g., the symmetric, dome-shaped bellows of FIGS. 1, 2 and 4. Exemplary resilient materials include, but are not limited to, elastics, rubbers, silicones, polyurethanes, etc.

Figure 4:
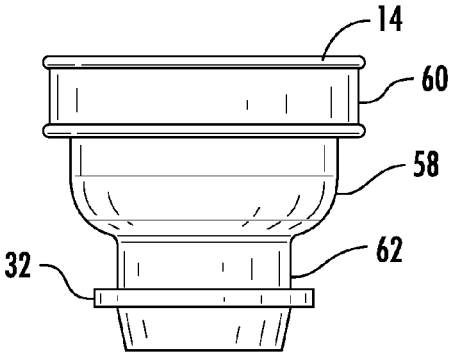
FIG. 4 is a side view of the bellows.
Figure 5A:
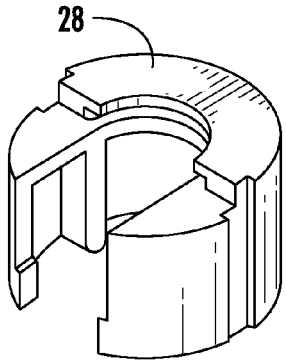
FIG. 5A is a perspective view of an actuator as described herein.
Figure 5B:
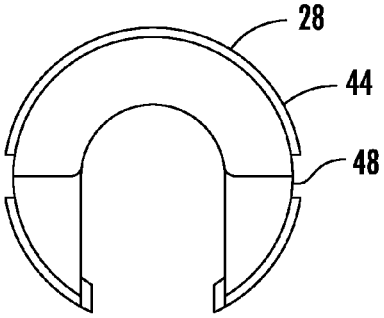
FIG. 5B is a top view of the same actuator.
Figure 5C:
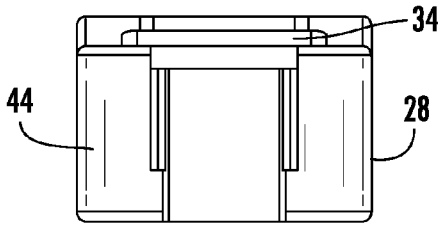
FIG. 5C is a front view of the same actuator.
Figure 5D:
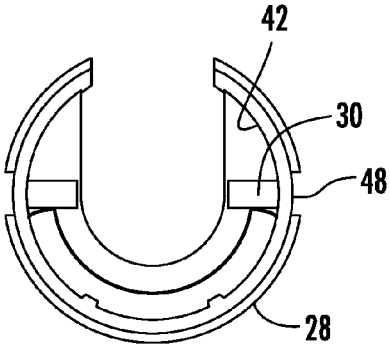
FIG. 5D is a bottom view of the same actuator.
Figure 5E:
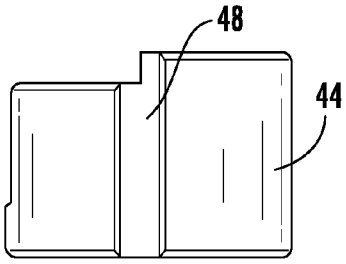
FIG. 5E is a side view of the same actuator.
Figure 6A:
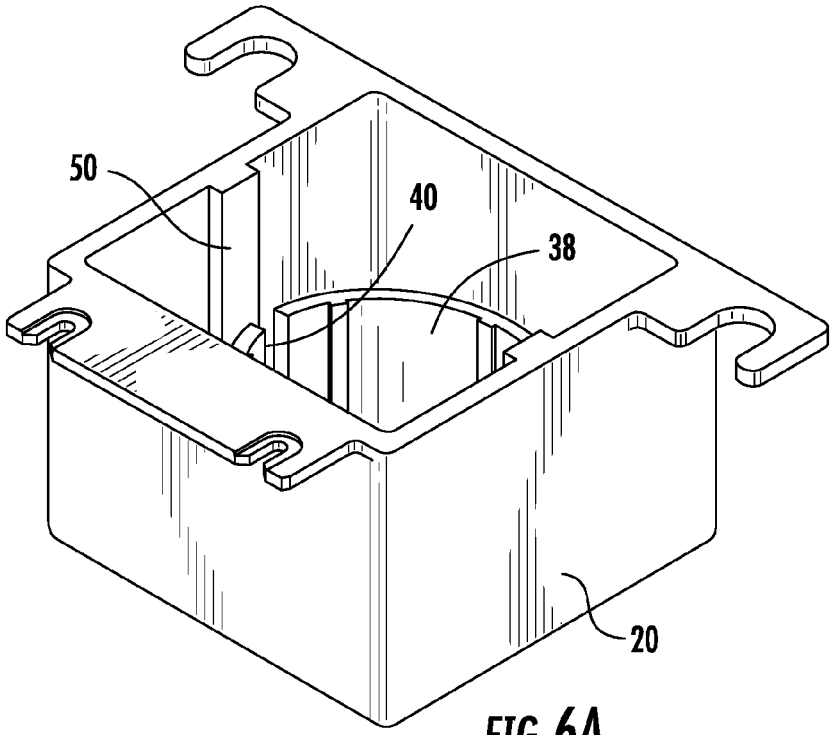
FIG. 6A is a perspective view of a housing described herein.
Figure 6B:
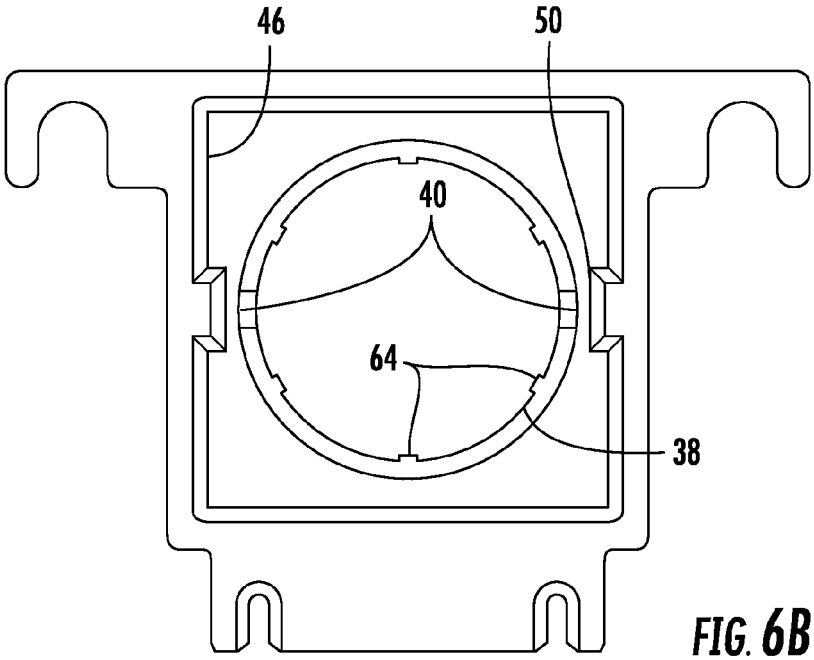
FIG. 6B is a bottom view of the same housing.
Figure 7D:
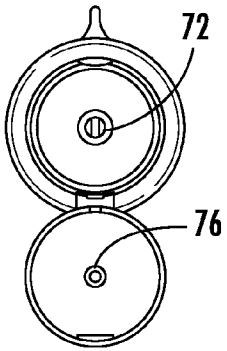
FIG. 7D is a top view of the same receptacle and cap
Figure 7B:
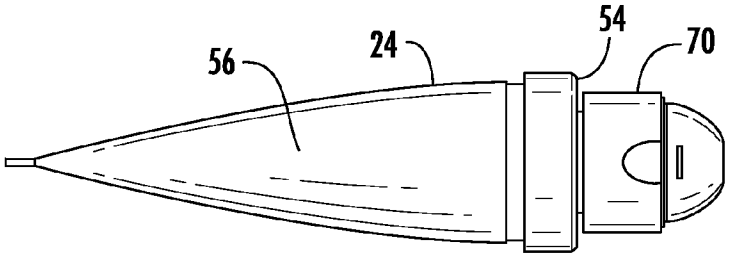
FIG. 7B is a side view of the same receptacle and cap.
Figure 7C:
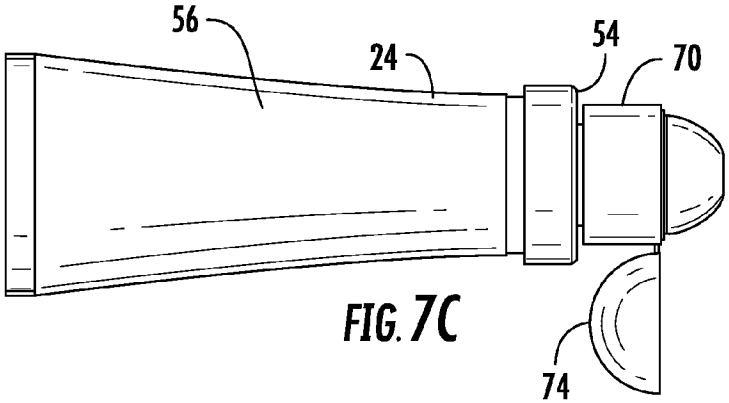
FIG. 7C is a front view of the same receptacle and cap.
Figure 7A:
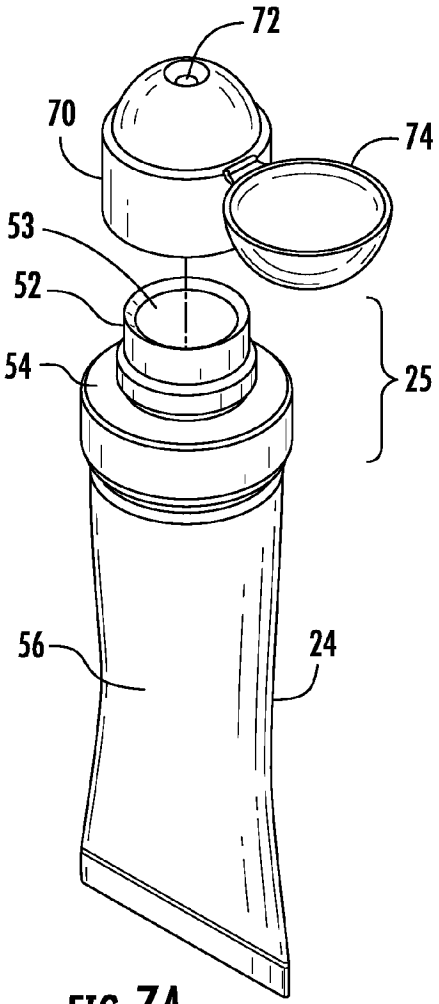
FIG. 7A is an exploded, perspective view of a receptacle and cap as described herein.

As shown in FIGS. 2 & 4, the bellows 14 can include a first linking portion 60 and a second linking portion 62, with a metering portion 58 between the linking portions 60, 62. The first linking portion 60 can be proximate to and in fluid communication with the inlet valve 16, while the second linking portion 62 can be proximate to and in fluid communication with the outlet valve 18. The first linking portion 60 can be proximate to and in fluid communication with the liquid reservoir 26. The bellows 14 can also include an outlet 19 adapted for interacting with an opening 53 at a proximal portion 25 of the receptacle 24 to prevent leakage when liquid is dispensed from the outlet valve 18 into the receptacle 24. As shown in FIGS. 2 & 4, the outlet valve 18 can be recessed within the outlet 19, which can be generally cylindrical with a tapered wall thickness reducing to a minimum at a distal end of the outlet 19.

The metering portion 58 can be dome-shaped, as shown in FIGS. 2 & 4. The metering portion 58 can be compressed when the receptacle 24 is inserted into the cavity 22 in order to dispense fluid from the one-way liquid metering device 12. Thus, the volume of liquid stored in the metering portion 58 when in its expanded state can be selected based on the desired amount of liquid to be dispensed when the receptacle 24 is inserted into the cavity 22 in order to dispense fluid from the one-way liquid metering device 12.

The liquid dispensing device 11 can include an actuator 28 for causing compression of the bellows 14 when a proximal end of the receptacle 24 is inserted into the cavity 22. The actuator 28 can include at least one surface 30 for engaging with a proximal portion 25 (e.g., the shoulder 54) of the receptacle 26 inserted into the cavity 26.

As shown in FIGS. 2A & B, the one-way liquid metering device 12 can include a flange 32 proximate the outlet valve 18 and/or an end of the one-way liquid metering device 12 proximate the outlet 19. The sides of the actuator 28 can be cylindrical and adapted to slide over the walls 38 defining the sides of the cavity. In other words, the diameter of the actuator 28 sides can be larger than the walls 38 of the cavity but small enough to fit inside the housing 20. The actuator 28 can include a groove 34 for engaging the flange 32. For example, as shown in FIG. 2, the groove 34 can be a channel and the flange 32 can be received within the channel 34.

As shown in FIGS. 2, 3A-C, 8 & 9B, the at least one surface 30 can include at least one projection 36 extending into the cavity 22 for engaging with a proximal portion (e.g., the shoulder 54) of the receptacle inserted into the cavity 22. As shown in FIGS. 2 & 3A-C, the actuator 28 can be slidably coupled to one or more walls 38 defining the cavity 22. For example, as shown in FIGS. 2 & 3A-C, the at least one projection 36 can extend inward toward the center of the cavity 22 and can slide longitudinally in at least one longitudinal slot 40 in the one or more walls 38. The at least one projection 36 can extend from an interior surface 42 of the actuator 28, e.g., from a cylindrical side 38 of the actuator 28, and into the cavity 22 through the at least one longitudinal slot 40. The projection 36 can be a pin, as shown in FIG. 8, or an elongated, vertically-oriented ridge, as shown in FIGS. 2A-D & 5.

Figure 3A:
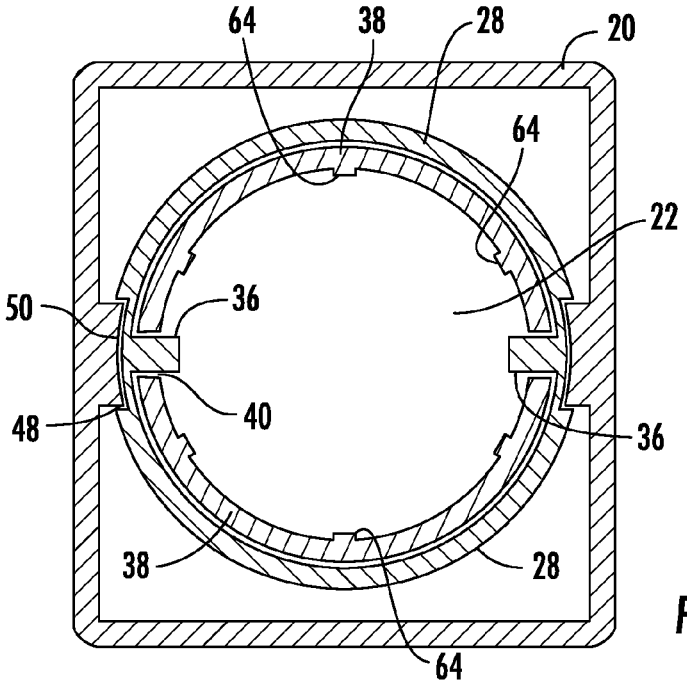
FIG. 3A is a cross-section view of the actuator-housing of the liquid dispensing device of FIG. 1 taken along cut line 3-3.
Figure 3B:
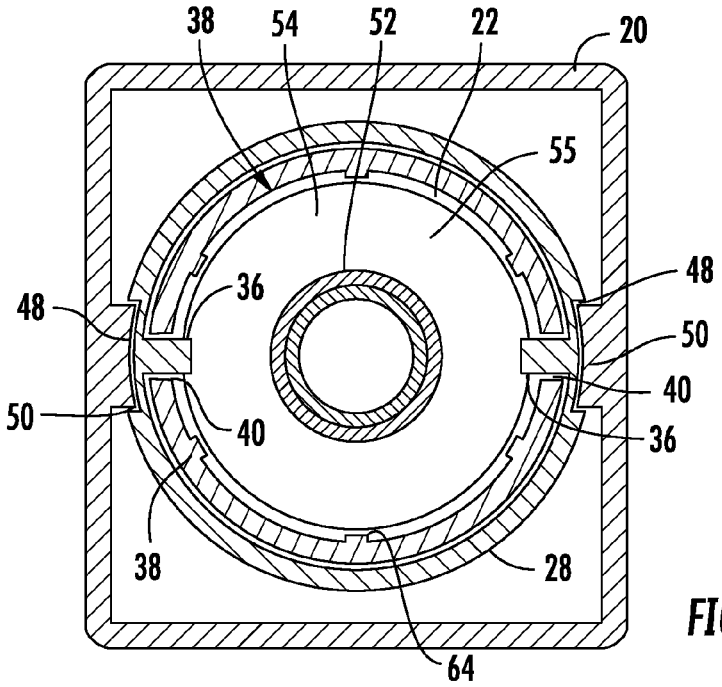
FIG. 3B is a cross-section of the same actuator-housing with the receptacle inserted in the cavity.
Figure 3C:
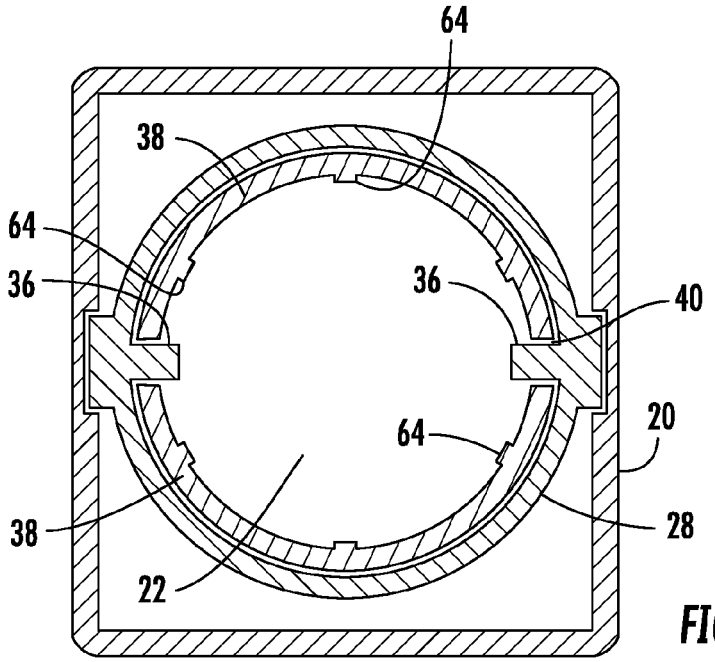
FIG. 3C is an alternate version of the actuator-housing of FIG. 3A where the projection-channel orientations are switched.

In addition, as shown in FIGS. 2 & 3A-D, an exterior surface 44 of the actuator 28 can be slidably coupled an interior surface 46 of the housing 20. For example, the exterior surface 44 of the actuator 28 can include at least one channel 48 and the interior surface 46 of the housing 20 can include at least one corresponding projection 50, as shown in FIGS. 2, 3A & 3B. Alternately, the exterior surface 44 of the actuator 28 can include at least one projection 50 and the interior surface 46 of the housing 20 can include at least one corresponding channel 48, as shown in FIGS. 3C & D. the actuator 28 can include at least two channels or projections and the housing can include at least 2 corresponding projections or channels, respectively.

The longitudinal-axes of the cavity 22 and the bellows 14 can be parallel, e.g., coaxial. Similarly, the cavity 22 and the liquid metering device 12 can be parallel, e.g., coaxial. The one-way liquid metering device 12 can be arranged generally vertically. The outlet valve 18 can be arranged to dispense liquid from the top of the cavity 22. For example, the outlet valve 18 can be in fluid communication with the cavity 22 through an opening (e.g., the outlet 19) at the top end of the cavity 22, while the receptacle 24 can be inserted into the cavity 22 through an opening at the bottom end of the cavity 22. The cavity 22 can be generally cylindrical in shape and can extend generally vertically from the bottom end to the top end.

As shown in FIGS. 2, 7 & 9, the receptacle 24 can include a neck 52 extending from a shoulder 54 at the proximal end 25 of the receptacle 24. The shoulder 54 can be adapted for engaging with the at least one surface 30 of the actuator 28 when the proximal end 25 of the receptacle is inserted into the cavity 22.

The shoulder 54 can be sized to fit within the cavity 22. As shown in FIG. 9, the shoulder 54 can be a flange 55, which can extend from the receptacle 24, e.g., from the neck 52. The neck 52 can have a smaller cross-sectional area (e.g., smaller diameter) than the shoulder 54, and both the neck 52 and the shoulder 54 can fit within the cavity 22. As shown in FIG. 7, the shoulder 54 can also be the top end 57 of the liquid storage compartment 56 of the receptacle 24. As shown in FIG. 9A, both the flange 55 and the top end 57 can be sized to fit within the cavity 22.

Figure 3D:
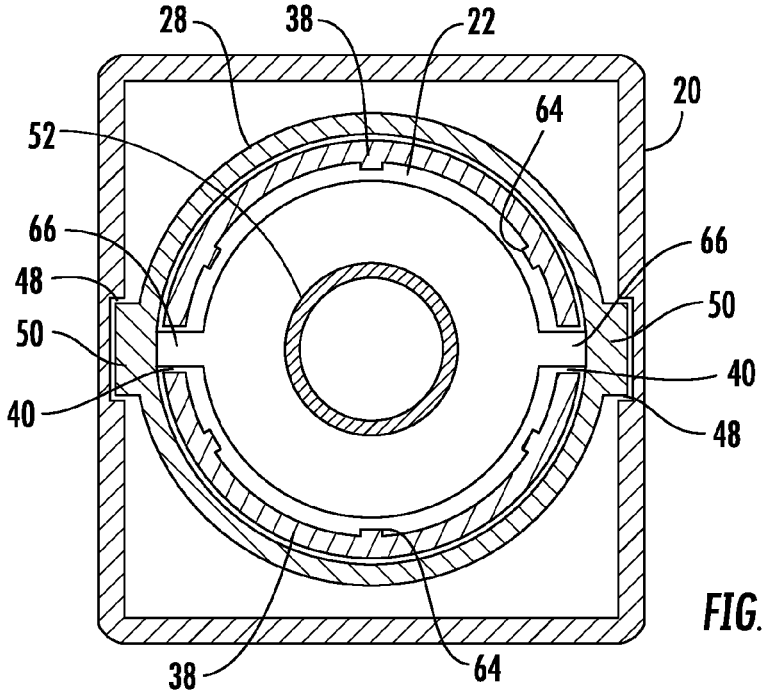
FIG. 3D is an alternate version of the actuator-housing of FIG. 3C where the flange includes tabs.

The shoulder 54 can include at least one tab 66 (e.g., projection) extending radially out from the longitudinal axis of the receptacle 24. As shown in FIG. 3D, the at least one tab 66 can be adapted to engage with the at least one surface 30 of the actuator 28. In such devices, the at least one tab 66 can extend through the slots 40 in the walls 38 in order to contact the at least one surface 30 of the actuator.

As shown in FIGS. 2 & 9, the proximal end 25 of the receptacle 24 and the cavity 22 can be sized such that the neck 52 is aligned with the outlet valve 18 when the receptacle 24 is inserted into the cavity 22. For example, the receptacle 24 and the cavity 22 can be sized such that liquid dispensed from the outlet valve 18 passes through the neck 52 and into the storage compartment 56 of the receptacle 24. As shown in FIGS. 2A & B, the liquid dispensing device 11 and receptacle 24 can be designed such that a seal is formed between the inlet/outlet of the neck 52 and the outlet 19 when the proximal portion of the receptacle 24 is inserted into the cavity 22.

The diameter of the proximal end of the receptacle 24 can be smaller than the diameter of the cavity 22. As shown in FIGS. 2 and 9B, the distance between opposing projections 36 can be greater than the diameter of the neck 52, but less than the diameter of the shoulder 54 of the receptacle 24. The projections 36 can extend 0.5 inches or less into the cavity 22, or 0.25 inches or less into the cavity 22, or 0.125 inches or less into the cavity 22, or 0.0625 inches or less into the cavity 22. This helps to prevent accidental discharge of the liquid, for example, when someone inserts a device other than the receptacle 24 into the cavity 22.

As shown in FIGS. 2A-D & 6, the cavity 22 can include at least two guides 64 extending from an interior of the at least one walls 38 defining the sides of the cavity 22. The guides can function to align the neck 52 and the outlet valve 18 when the receptacle 24 is inserted into the cavity 22 and insure proper contact with the shoulder 54 and the at least one surface 30.

The actuator 28 can be adapted to cause compression of the bellows 14 when the proximal end of the receptacle 24 is inserted into the cavity 22. The actuator 28 can include at least one surface 30 or at least two surfaces 30 for engaging with a proximal portion (e.g., the shoulder 54) of the receptacle 24 inserted into the cavity 22.

The liquid dispensing device 11 shown in FIGS. 8 & 9 includes a different actuation mechanism, but can otherwise be substituted into the systems and methods described herein. In the mechanism 11 described herein, like parts are described using like terminology and reference numerals and descriptions of like parts can be applied to any of the liquid dispensing devices 11 described herein.

In the mechanisms 11 of FIGS. 8 & 9, the actuator 28 can include a pivotably mounted lever 112, a first pin 114 and a second pin 116. The pivotably mounted lever 112 can include at least one surface 30 for engaging with a proximal portion (e.g., the shoulder 54) of the receptacle inserted into the cavity 22. As described elsewhere herein, the at least one surface 30 can be a projection 36 protruding into the cavity 22 through a slot 40 in the wall 38 defining the cavity 22.

The first pin 114 can be adapted for contacting the lever 112 (e.g., the primary beam 123) and sliding vertically upward when the lever 112 pivots upward. The second pin 116 can be adapted for contacting the first pin 114 and sliding horizontally when the first pin 114 slides upward into the second pin 116. The lever 112, first pin 114, and second pin 116 can be arranged such that the second pin 116 compresses the bellows 14 when a proximal portion 25 of a receptacle 24 is inserted into the cavity 22 causing the lever 112 to pivot upward.

As shown in FIGS. 8 & 9, the actuator 28 can include at least one projection 36 extending into the cavity 22 for engaging with a proximal portion (e.g., the shoulder 54) of the receptacle 24 inserted into the cavity 22. The pivotably mounted lever 112 can include a primary beam 123 and two leg 124 extending from a distal end of the beam 123. The legs can be adapted so that they extend to opposite side of the cavity 22. The legs 124 can include projections 36 that extend through slots 40 in the wall 38 defining the sides of the cavity 22 and into the cavity 22. The legs 124 can be positioned between the cavity walls 38 and the interior walls of the housing 20. A proximal end of the primary beam 123 can be pivotably mounted to a fixed portion of the liquid dispensing device 11.

As shown in FIGS. 8 & 9, the bellows 30 can include resilient, compressible tubing 118 with an inlet valve 16 at a first end proximate the liquid reservoir 26, and an outlet valve 18 at an opposite end proximate the cavity 22. The outlet valve 18 can be positioned such that liquid from the compressible tubing 118 is dispensed through the outlet valve 18 into the cavity 22 when the compressible tubing 118 is compressed by the actuator 28 (e.g., the second pin 116). The inlet valve 16 can be positioned such that liquid from the liquid reservoir 26 is drawn into the compressible tubing 118 when the compressible tubing 118 returns to its original shape following compression. The inlet valve 16 and outlet valve 18 can be one-way valves.

When the actuator 28 is actuated by proper insertion of the receptacle 24 into the cavity 22, the compressible tubing 118 can be compressed between the second pin 116 and a resistance wall 120 located on a side of the compressible tubing 118 opposite the second pin 116. The resistance wall 120 can remain stationary during the actuation sequence.

As shown in FIGS. 8 & 9A, the firs pin 114 can include an angled surface 122 for contacting the second pin 116. As shown in FIGS. 8 & 9A, the distance between the compressible tubing 118 and the angled surface 122 can be larger proximate a top of the first pin 114 than an intermediate portion of the first pin 114. Thus, as the first pin 114 slides up vertically, the second pin 116 slides horizontally toward the compressible tubing 118 and compresses the compressible tubing 118 causing the liquid within the compressible tubing 118 to be dispensed from the outlet valve 18 and into a receptacle 24 inserted into the cavity 22. FIG. 9A shows the compressible tubing 118 in the compressed state (i.e., with the actuator 28 compressing the compressible tubing 118). Once the receptacle 24 is released from the cavity 22, the actuator 28 will return to the start position (e.g., as shown in FIG. 8), and fluid from the liquid reservoir 26 will be drawn into the bellow 14/compressible tubing 118 through the inlet valve 16.

A method of dispensing liquid into a receptacle 24 is also described. The method can include providing a liquid dispensing device 11 as described herein, and a receptacle 24 having a proximal end 25 adapted for insertion into a cavity 22 of the liquid dispensing device 11. The proximal end 25 of the receptacle 25 can then be inserted into the cavity 22 to dispense a liquid from the liquid dispensing device 11.

The method can also include providing a least one additional liquid dispensing device 20 as described herein, and inserting the proximal end 25 of the receptacle 24 into the cavity 22 of the second liquid dispensing device 11 to dispense a liquid from the second liquid dispensing device 11.

When the various liquid dispensing devices 10 include differently colored liquid (e.g., liquid candy) of a sufficient viscosity, the liquid dispensed into the receptacle 24 will remain in discrete layers, which can be viewed by the consumer if the body of the receptacle 24 is transparent. This is an additional benefit of the of the method described herein.

As described above, the actuator 28 can be slidably coupled to the housing 20 and coupled to the flange 32 of the bellows 14 via the actuator groove 34. The actuator 28 and bellows 14 can be aligned coaxially (e.g., generally vertically). The cavity 22 can also be aligned coaxially with the actuator 28 and bellows 14. Thus, when the proximal end 25 of the receptacle 24 is inserted coaxially (e.g., generally vertically) into the cavity 22, the shoulder 54 will engage the at least one surface 30 of the actuator 28 causing the actuator 28 to slide upward, thereby compressing the metering portion 58 of the bellows 14. The compression of the metering portion 58 will cause liquid contained within the bellows to be dispensed through the outlet valve 18 and into the storage compartment 56 of the receptacle 24 via the neck 52. When the proximal end 25 of the receptacle is removed from the cavity 22, the actuator and bellows 14, including the metering portion 58, can return to their starting position causing liquid in the liquid reservoir 26 to pass through the inlet valve 16 and into the liquid metering device 12 (e.g., the bellows 14).

Thus, using the liquid metering device 12, the user can pump discrete amounts of liquid into the receptacle 24 without spilling. In particular, the liquid dispensing device 11 is designed to prevent spills of the candy because (i) only discrete amounts of liquid are discharged at a time, (ii) the actuator 28 is designed to prevent discharge except when the proximal end 25 of the corresponding receptacle 24 is inserted into the cavity 22, and (iii) the combination of receptacle 24 and cavity 22 (which can include alignment guides 64) are designed to ensures that the neck 52 is aligned to receive the liquid when the liquid is dispensed from the outlet valve 18. This is particularly useful where the liquid is liquid candy with a high sugar content, other messy substances, or, alternately, non-edible or toxic substances.

The foregoing is provided for purposes of illustrating, explaining, an describing embodiments of the method and system. Modifications and adaptations to these embodiments will be apparent to those skilled in the art and may be made without departing from the scope or spirit of this disclosure. In particular, it is intended that each of the variants described above can be combined with any of the other variants described above.

The invention claimed is:

1. A liquid dispensing device, comprising:

a one-way liquid metering device, comprising a bellows, an inlet valve, and an outlet valve, and a housing, comprising a cavity, wherein said outlet valve is recessed within said cavity, wherein liquid is dispensed from said one-way metering device into said cavity when a proximal portion of a receptacle is inserted into said cavity.

2. The liquid dispensing device according to claim 1, wherein liquid within said bellows is dispensed from said outlet valve when said bellows is compressed, and wherein liquid is drawn into said bellows through said inlet valve when said bellows returns to an expanded state.

3. The liquid dispensing device according to claim 1, wherein longitudinal-axes of said cavity and said bellows are parallel.

4. The liquid dispensing device according to claim 1, wherein an end of said one-way liquid metering device is in fluid communication with a fluid reservoir.

5. The liquid dispensing device according to claim 1, further comprising an actuator for causing compression of said bellows when a proximal end of a receptacle is inserted into said cavity, said actuator comprising at least one surface for engaging with a proximal portion of a receptacle inserted into said cavity.

6. The liquid dispensing device according to claim 5, wherein said metering device comprises a flange proximate said outlet valve and said actuator further comprises a groove for engaging said metering device flange.

7. The liquid dispensing device according to claim 5, wherein said at least one surface comprises at least one projection extending into said cavity.

8. The liquid dispensing device according to claim 5, wherein said actuator is slidably coupled with one or more walls defining said cavity via said at least one projection.

9. The liquid dispensing device according to claim 8, wherein said at least one projection extends from an interior surface of said actuator.

10. The liquid dispensing device according to claim 9, wherein an exterior surface of said actuator is slidably coupled to an interior surface of said housing.

11. The liquid dispensing device according to claim 8, wherein an exterior surface of said actuator is slidably coupled an interior surface of said housing.

12. The liquid dispensing device according to claim 4, wherein said actuator comprises;

a pivotably mounted lever having said at least one projection extending from a distal end thereof;

a first pin for sliding vertically upward when said lever pivots upward; and a second pin for sliding horizontally when said first in slides upward, wherein said lever, first pin and second pin are arranged such that said second pin compresses said bellows when a proximal portion of a receptacle is inserted into said cavity.

13. A system for liquid dispensing, comprising:

a liquid dispensing device according to claim 1; and a receptacle having a proximal end adapted for insertion into said cavity.

14. The system according to claim 13, wherein said receptacle further comprises a neck extending from a shoulder at the proximal end of the receptacle, wherein said shoulder fits within said cavity.

15. The system according to claim 13, wherein said liquid dispensing device, further comprises an actuator for causing compression of said bellows when the proximal end of the receptacle is inserted into said cavity, said actuator comprising at least one surface for engaging with said proximal end of said receptacle.

16. The system according to claim 15, wherein said receptacle further comprises a neck extending from a shoulder at the proximal end of the receptacle, wherein said shoulder engages with said at least one surface.

17. The system according to claim 13, further comprising an actuator for causing compression of said bellows when a proximal end of a receptacle is inserted into said cavity, said actuator comprising at least one surface for engaging with a proximal portion of a receptacle inserted into said cavity.

18. The system according to claim 13, wherein said one-way liquid metering device comprises a flange proximate said outlet valve and said actuator further comprises a groove for engaging said flange.

19. A method of dispensing a liquid into a receptacle, comprising:

providing a liquid dispensing device according to claim 1 and a receptacle having a proximal end adapted for insertion into a cavity of said liquid dispensing device; and inserting said proximal end into said cavity to dispense a liquid from said liquid dispensing device.

20. The method according to claim 19, further comprising:

providing a second liquid dispensing device; and inserting said proximal end into a cavity of said second liquid dispensing device to dispense a liquid from said second liquid dispensing device.

* * * * *